US005287704A

United States Patent [19]

Rathbone

[11] Patent Number: 5,287,704

[45] Date of Patent: Feb. 22, 1994

[54] AIR SEPARATION

[75] Inventor: Thomas Rathbone, Surrey, England

[73] Assignee: The BOC Group, plc, Surrey, England

[21] Appl. No.: 976,249

[22] Filed: Nov. 12, 1992

[30] Foreign Application Priority Data

Nov. 14, 1991 [GB] United Kingdom ..... 9124242

[51] Int. Cl.[5] ..... F25J 3/02

[52] U.S. Cl. ..... 62/25; 62/38; 62/41

[58] Field of Search ..... 62/25, 41, 38, 39

[56] References Cited

U.S. PATENT DOCUMENTS 4,883,518 11/1989 Skolaude et al. ..... 62/38
4,895,583 1/1990 Flanagan et al. ..... 62/24
5,074,898 12/1991 Cheurg ..... 62/38

FOREIGN PATENT DOCUMENTS 0024962 7/1980 European Pat. Off. .
0420725 9/1990 European Pat. Off. .
2251931 7/1992 United Kingdom .

*Primary Examiner*—Ronald C. Caposela
*Attorney, Agent, or Firm*—David M. Rosenblum; Larry R. Cassett

[57] ABSTRACT

A method of separating air in which a compressed air stream is divided into first and second subsidiary streams. The first subsidiary air stream is cooled by heat exchange to a temperature suitable for its separation by rectification and introduced into the higher pressure stage of a double rectification column. The second subsidiary air stream is further compressed and then at least part of it is cooled by heat exchange to a first intermediate temperature below ambient temperature but above those temperatures at which the double rectification column operates. The thus cooled second subsidiary air stream is expanded in a first expansion turbine and is withdrawn therefrom at a second intermediate temperature below the first intermediate temperature but above those temperatures at which the double rectification column operates. After withdrawal, the second subsidiary air stream is introduced into a second expansion turbine where it is further expanded. After the further expansion, the second subsidiary air stream is introduced into the lower pressure rectification stage of the double rectification column. Air is separated in the double rectification column into oxygen and nitrogen. Oxygen and nitrogen streams are withdrawn from the said lower pressure stage and a part of at least one of the oxygen and nitrogen is produced as a liquid product.

12 Claims, 1 Drawing Sheet

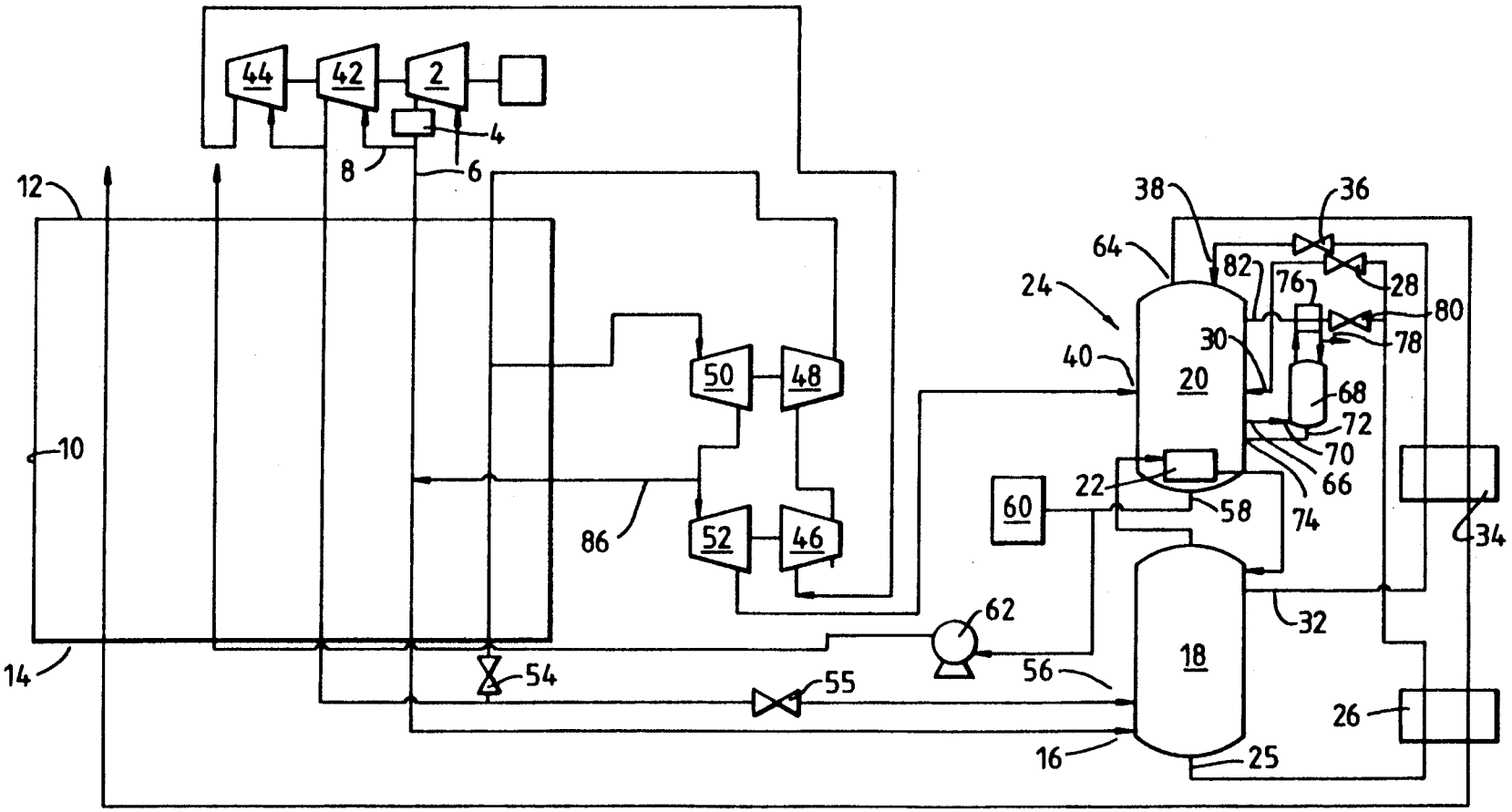
34
80
28
78
36
68
72
70
66
76
74
32
26
82
30
58
25
38
20
18
64
40
22
24
60
56
16
62
55
48
46
50
52
86
54
4
6
2
42
8
44
12
10
14

AIR SEPARATION

BACKGROUND OF THE INVENTION

This invention relates to air separation.

Modern chemical and metallurgical processes including an oxidation step call for ever larger quantities of oxygen. Oxygen can be produced in quantities in excess of 2,000 tonnes per day by an air separation process which comprises compressing an air stream, purifying the air stream by removing therefrom components of relatively low volatility such as water vapour and carbon dioxide, cooling the thus purified air stream to a temperature suitable for its separation by fractional distillation or rectification, and then performing that separation so as to produce oxygen product of desired purity. The purification is preferably performed by beds of adsorbent which adsorb the components of low volatility such as water vapour and carbon dioxide. The fractional distillation or rectification of the air is preferably performed in a double rectification column comprising a higher pressure stage and a lower pressure stage that typically share a heat exchanger effective to condense nitrogen at the top of a higher pressure column and reboil oxygen-rich liquid at the bottom of the lower pressure column. Some of the thus formed liquid nitrogen is used as reflux in the higher pressure column while the remainder is typically removed from the higher pressure column, is sub-cooled, and is passed through an expansion valve into the top of the lower pressure column so as to provide reflux for that column, the air being introduced into the higher pressure column. Oxygen-enriched liquid air is withdrawn from the bottom of the higher pressure column and is passed to the lower pressure column where it it typically separated into substantially pure oxygen and nitrogen products. These products may be withdrawn from the lower pressure column in the gaseous state and warmed to ambient temperature in countercurrent heat exchange with the incoming air, thereby effecting the cooling of the incoming air. Since such a process operates at cryogenic temperatures, refrigeration has to be generated. This is typically done either by expanding a part of the incoming air in a turbine or by taking a stream of nitrogen from the higher pressure column and passing it through an expansion turbine.

In DE-A-2 854 508 there is disclosed a process in which all the air exiting the turbine is introduced into the lower pressure column. Such a process offers the advantage that introduction of the turbine-expanded air into the lower pressure column helps to enhance the thermodynamic efficiency with which rectification takes place when there is not a requirement to produce either a liquid oxygen or a liquid nitrogen product. The process is however limited in that it is generally not suitable for use when it is desired to produce liquid oxygen and/or liquid nitrogen products (in addition to a gaseous oxygen and/or gaseous nitrogen product) in a total amount of more than 5% of the gaseous oxygen product.

It is also known to provide refrigeration for an air separation process by arranging for an air expansion turbine to exhaust into a higher pressure column. Such a process therefore entails compressing the air to a higher pressure than those at which the double rectification column operates. Such a process is disclosed in U.S. Pat. No. 2,779,174. By arranging for the expansion turbine to exhaust into the higher pressure column, it is possible to obtain a greater yield of liquid oxygen or liquid nitrogen than in the process described in DE-A-2 854 508. Our analysis shows however that the process is relatively inefficient thermodynamically, especially when the liquid production is in the range of 10 to 50% of the plant output.

A large number of proposals also exist in the art for using two expansion turbines in parallel with one another to generate refrigeration for the process and to enable any desired proportion of the oxygen and nitrogen products to be produced in liquid state. An example of such a proposal is given in U.S. Pat. No. 4,883,518. In general, in comparison with single turbine systems, additional passes are required through the heat exchanger in which the air is cooled. Moreover, such processes employing two turbines in parallel require a large proportion of the turbine-expanded air to be directed other than to the lower pressure column.

EP-A-0 420 725 discloses an air separation cycle in which a part of a main compressed air stream is withdrawn from a main heat exchanger at a first intermediate location; is expanded in a first turbine; is returned through the heat exchanger from its cold end to a second intermediate location at a higher temperature than the first intermediate location; is withdrawn from the second intermediate location is expanded in a second turbine, which therefore operates at higher temperatures than the first turbine; and is then mixed with an impure nitrogen stream flowing through the main heat exchanger from its cold end to its warm end. The entire air stream is compressed to a relatively high pressure in the order of 30 bar and all the oxygen product is produced as liquid.

SUMMARY OF THE INVENTION

It is an aim of the present invention to provide an air separation method and apparatus which employ a series arrangement of expansion turbines to expand a part of the air to be separated, thereby making it possible for a part of the oxygen and/or nitrogen products to be produced in liquid state while most or all of the turbine-expanded air is able to be supplied to the lower pressure column.

According to the present invention there is provided a method of separating air, comprising dividing a compressed air stream into first and second subsidiary streams, cooling the first subsidiary air stream by heat exchange to a temperature suitable for its separation by rectification, introducing the thus cooled air stream into the higher pressure stage of a double rectification column, further compressing the second subsidiary air stream, cooling at least part of it by heat exchange to a first intermediate temperature below ambient temperature but above those temperatures at which the double rectification column operates, expanding the thus cooled second subsidiary air stream in a first expansion turbine, withdrawing the thus expanded second subsidiary air stream from the first expansion turbine at a second intermediate temperature below the first intermediate temperature but above those temperatures at which the double rectification column operates and introducing it into a second expansion turbine, further expanding the second subsidiary air stream in the second expansion turbine and withdrawing the thus expanded second subsidiary air stream therefrom and introducing it into the lower pressure rectification stage of the double rectification column, separating the air in the double rectification column into oxygen and nitrogen, withdrawing oxygen and nitrogen streams from the said lower pressure stage, and producing a part of one or both of the oxygen and nitrogen as a liquid product.

The invention also provides apparatus for separating air, comprising a first air compressor, first and second conduits each communicating with the outlet of the first air compressor, whereby, in use, air leaving the first air compressor is able to be divided into respectively first and second subsidiary air streams, at least one heat exchanger for cooling the first subsidiary air stream by heat exchange to a temperature suitable for its separation by rectification, a double rectification column comprising a lower pressure rectification stage and a higher pressure rectification stage, an inlet to the higher pressure rectification stage for the cooling first subsidiary air stream, at least one second air compressor having an inlet for receiving the second subsidiary air stream and an outlet communicating with said heat exchanger so as to enable air compressed in said at least one second air compressor to be cooled in the heat exchanger, a first expansion turbine for expanding the second subsidiary air stream able in use to withdraw at least part of the second subsidiary air stream from said at least one heat exchanger at a first intermediate temperature below ambient temperature but above those temperatures at which the double rectification column operates in use of the apparatus, and to discharge the second subsidiary air stream at a second intermediate temperature lower than the first intermediate temperature and higher than the temperatures at which the double rectification column operates in use of the apparatus, a second expansion turbine for expanding the second subsidiary air stream able in use to receive said second subsidiary air stream from the outlet of the first expansion turbine and to pass the second subsidiary air stream after expansion therein to an inlet to the lower pressure rectification stage, and outlets for withdrawing oxygen and nitrogen streams from the lower pressure stage of the double rectification column, at least one such outlet communicating at one of its ends with liquid nitrogen or liquid oxygen in the double rectification column and at its other end with a storage vessel for such liquid.

Preferably the inlet temperature and pressure of the air entering the second expansion turbine are each the same as respectively the outlet temperature and pressure of the first expansion turbine. Thus, the second subsidiary air stream may leave the first expansion turbine and pass to the second expansion turbine without entering into heat exchange relationship with any other fluid stream. Such an arrangement simplifies the construction of the heat exchanger or heat exchangers in which the air is cooled in comparison with conventional plants employing parallel arrangements of turbines for the expansion of air.

Preferably, the pressure at which the second subsidiary air stream enters the first expansion turbine is from 30 to 40 times higher than the outlet pressure of the second expansion turbine. Such a large pressure ratio makes possible efficient operation of both turbines. The outlet pressure of the second turbine is generally selected to be in the order of the pressure at which the lower pressure rectification column operates. Accordingly, the second subsidiary air stream is compressed to a pressure well in excess of that of the compressed air stream, and more than one second air compressor is typically used for this purpose. Preferably, compression of the second subsidiary air stream is carried out, in part, in at least one compressor mounted on the same shaft as the first compressor and then in two booster-compressors, one of which is preferably driven by the first expansion turbine and the other of which is preferably driven by the second expansion turbine.

At least some of the oxygen withdrawn from the lower pressure rectification stage is preferably returned through said at least one heat exchanger countercurrently to said first subsidiary air stream. Preferably the oxygen stream is at least in part withdrawn in liquid state. In one preferred example of a method according to the invention, all the oxygen withdrawn from the lower pressure stage is in the liquid state. Preferably, a part of such liquid oxygen is stored as product while the remainder is pumped through the said at least one heat exchanger countercurrently to said first subsidiary air stream so as to produce a relatively high pressure gaseous oxygen product stream. In order to maintain reasonably efficient heat exchange in said at least one heat exchanger, notwithstanding that this heat exchanger is used to vaporise liquid oxygen, a third subsidiary air stream may be passed therethrough countercurrently to the liquid oxygen stream at a pressure typically in the order of 2 to 3 times the pressure at which the high pressure oxygen stream is produced. The third subsidiary air stream is preferably taken from the second subsidiary air stream. Downstream of its heat exchange with the liquid oxygen stream, the third subsidiary air stream is preferably passed through a Joule-Thomson or throttling valve into the higher pressure rectification stage. Some of the nitrogen withdrawn from the lower pressure rectification stage may be taken in the liquid state and passed to storage as product. The remaining nitrogen withdrawn from the lower pressure rectification stage is preferably passed through said at least one heat exchanger countercurrently to the first subsidiary air stream.

Preferably the overall rate at which liquid oxygen and/or liquid nitrogen is passed to storage is from 10 to 40% of the rate at which oxygen product is withdrawn from the lower pressure column.

Preferably the apparatus according to the invention includes a conduit which affords communication between an intermediate region of a passage through said at least one heat exchanger that in use conducts the first subsidiary air stream therethrough and a conduit which conducts the second subsidiary air stream from the outlet of the first expansion turbine to the inlet of the second expansion turbine. Accordingly, by selecting the relative pressures of the first and second subsidiary air streams at the chosen locations, it becomes possible either to divert some of the first subsidiary air stream into the second expansion turbine and thus enhance the amount of refrigeration produced, thereby enabling a greater proportion of the products of the air separation to be produced in liquid state, or alternatively to divert some of the second subsidiary stream into the first subsidiary air stream and thereby reduce the overall amount of refrigeration produced and hence the proportion of oxygen and nitrogen products sent in liquid state to storage. Such an arrangement makes it possible to select the amount of products produced as liquid without substantially affecting the overall rate of production of oxygen and nitrogen. Preferably, such flow of fluid between the first and second subsidiary air streams is less than 10% of the flow of the second subsidiary air stream into the inlet of the second expansion turbine.

If desired, an argon product may be produced by taking an argon-enriched oxygen stream from the lower pressure stage and rectifying it in a further rectification column. The resulting argon typically contains up to 2% by volume of oxygen and may, if desired, be further purified.

In common with conventional air separation processes, if the air has not been pretreated to remove impurities of relatively low volatility, such as water vapour and carbon dioxide, therefrom, then such a treatment is performed. The treatment is preferably performed downstream of the first compressor and upstream of where the air is divided into the first and secondary subsidiary streams.

The method and apparatus according to the invention offer the advantage of making possible production of liquid oxygen and/or liquid nitrogen products at a rate of from 10 to 40% of the total rate of production of oxygen product more efficiently than comparable processes employing just one expansion turbine without there being a need to add additional passes through said at least one heat exchanger.

BRIEF DESCRIPTION OF THE DRAWING

The method and apparatus according to the invention are now described by way of example with reference to the accompanying drawing which is a flow diagram illustrating an air separation plant.

The drawing is not to scale.

DETAILED DESCRIPTION

With reference to the drawing, a first air compressor 2 draws in air from the atmosphere and compresses it typically to a pressure of about 6.5 bar. The air is then passed through a purification apparatus 4 (of a kind sometimes referred to as a prepurification unit or PPU) effective to remove low volatility impurities, principally water vapour and carbon dioxide, from the incoming air. The apparatus 4 is of the kind which employs beds of adsorbent (e.g. a molecular sieve such as zeolite) to adsorb the water vapour and carbon dioxide from the incoming air but to allow its principal components, oxygen, nitrogen and argon, to pass therethrough. The beds may be operated out of sequence with one another such that when one or more beds are being used to purify the air, the remaining bed or beds are being regenerated, typically by means of a stream of nitrogen. The purified air stream is then divided into a first subsidiary air stream which flows along a conduit 6 and a second subsidiary air stream which flows along a conduit 8.

The first subsidiary air stream passes from the conduit 6 through a heat exchanger 10 from its warm end 12 to its cold end 14 so as to reduce the temperature of the air to a level suitable for separation by rectification, i.e. to a temperature in the order of 100K. The stream then flows from the cold end 14 of the heat exchanger 10 through an inlet 16 into the higher pressure rectification stage 18 of a double rectification column 24 comprising the stage 18, a lower pressure stage 20 and a condenser-reboiler 22 linking in a conventional manner the lower pressure stage 20 to the higher pressure stage 18. Both the higher pressure stage 18 and the lower pressure stage are provided with suitable liquid-vapour contact means (not shown), such as trays or (structured) packing, or a combination of both trays and packing, to enable mass transfer to take place between a descending liquid phase and an ascending vapour phase. Accordingly, the stream of gaseous air introduced into the higher pressure stage 18 through the inlet 16 comes into mass transfer relationship with a descending flow of liquid as it ascends the stage 18. The liquid becomes progressively richer in oxygen and the vapour progressively richer in nitrogen. A liquid oxygen rich fraction is withdrawn through an outlet 25 from the the bottom of the higher pressure column 18, is sub-cooled in a heat exchanger 26, that is to say is cooled to a temperature below its liquefaction point at the prevailing pressure, is passed through a Joule-Thomson or throttling valve 28 and is introduced into the lower pressure rectification stage 20 through an inlet 30. The condenser-reboiler 22 receives a stream of nitrogen vapour from the top of the higher pressure rectification stage 18. A part of the resulting condensate is used to provide reflux for the higher pressure stage 18, while another part withdrawn from the stage 18 through an outlet 32, is sub-cooled in a heat exchanger 34, is passed through a throttling or Joule-Thomson valve 36 and is introduced into the top of the lower pressure rectification stage 20 through an inlet 38 to provide reflux for this stage. Reboil for the rectification stage 20 is provided by the condenser-reboiler 22.

As well as receiving the oxygen-rich liquid for separation through the inlet 30, the lower pressure rectification stage 20 also receives the second subsidiary stream of air through an inlet 40.

The second subsidiary stream of air flows from the aforesaid conduit 8 into a compressor 42 and is typically compressed therein to a pressure of about 16 bar. The second subsidiary air stream is then compressed again in yet another compressor 44 and its pressure is raised thereby to about 25 bar. The compressors 2, 42 and 44 are typically of the rotary kind, their rotors (not shown) typically being mounted on the same drive shaft as one another.

The second subsidiary air stream flows from the compressor 44 to a first booster compressor 46 and is further compressed therein. The resulting further compressed air flows out of the booster compressor 46 and enters a further booster compressor 48 in which it is still further compressed. The second subsidiary air stream leaves the booster-compressor 48 at a pressure in the order of 50 bar and is then introduced into the heat exchanger 10 at its warm end 12. The second subsidiary air stream then flows through the heat exchanger 10 cocurrently with the first subsidiary air stream. A major proportion, typically 70%, of the second subsidiary air stream is withdrawn from the heat exchanger 10 at a temperature of about 220K (and typically in the range of 200 to 230K) and is expanded from a pressure of about 50 bar to a pressure of about 6.5 bar in a first expansion turbine 50. The resulting expanded air leaves the turbine 50 at a temperature of about 130K (and typically in the range of 125 to 135K) and then passes into a second expansion turbine 52 in which it is expanded to a pressure of about 1.5 bar. The resulting expanded air leaves the second expansion turbine 52 at a temperature of about 90K and then flows to the inlet 40 for introduction into the lower pressure rectification stage 20. The first expansion turbine 50 is employed to drive the second booster-compressor 48 and the second expansion turbine 52 is employed to drive the first booster compressor 46.

That portion of the second subsidiary air stream which is not withdrawn from the heat exchanger 10 at a temperature of about 210K continues to flow through the heat exchanger 10 and leaves the cold thereof at a temperature of about 100K. It then flows through throttling valves 54 and 55 to reduce its pressure to that of the higher pressure rectification stage 18 and is introduced therein as a saturated liquid through an inlet 56. This air is therefore separated in the higher pressure rectification stage 18 with that air introduced through the inlet 16.

The oxygen-rich liquid and second subsidiary air streams that are introduced into the lower pressure rectification stage 20 through the inlets 30 and 40 respectively are separated by rectification therein into relatively pure oxygen and nitrogen fractions. A liquid oxygen product is withdrawn from the bottom of the lower pressure stage 20 through an outlet 58. From 10 to 40% of the liquid oxygen so withdrawn is taken as product and passed into a storage vessel 60. The remainder of this liquid oxygen flow is pumped by a pump 62 through the heat exchanger 10 from its cold end 14 to its warm end 12 and is thus vaporised by heat exchange therein. A gaseous oxygen product leaves the warm end 12 of the heat exchanger 10 at a pressure of about 6 bar. In order to maintain a relatively close match between the enthalpy-temperature profile of the streams being warmed in the heat exchanger 10 and that of the streams being cooled therein, a portion of the second subsidiary air stream is withdrawn therefrom at a region intermediate the compressors 42 and 44 and flows as a third subsidiary air stream through the heat exchanger 10 from its warm end 12 to its cold end 14, being liquefied by its passage therethrough. The resulting liquid air stream is then united at a region intermediate the throttling or Joule-Thomson valves 54 and 55 with that part of the 50 bar second subsidiary air stream that does not flow to the expansion turbine 50.

A stream of gaseous nitrogen is withdrawn from the top of the lower pressure rectification stage 20 through an outlet 64 and is then passed, in sequence, through the heat exchanger 34 in which the liquid nitrogen taken from the higher pressure rectification column 18 is sub-cooled; the heat exchanger 26, in which the oxygen-rich liquid taken from the bottom of the higher pressure rectification column is sub-cooled; and the heat exchanger 10 from its warm end 14 to its cold end 12, thereby providing cooling for these heat exchangers. The resulting nitrogen stream leaves the warm end 12 of the heat exchanger 10 at approximately ambient temperature. Some of it may be used to help regenerate adsorbent beds (not shown) of the purification apparatus 4.

The plant shown in the drawing may also be used the produce a crude argon product. Accordingly, a stream of argon-enriched oxygen is withdrawn from the lower pressure rectification stage 20 through an outlet 66 and enters a further rectification column 68 through an inlet 70. The further rectification column 68 is provided with liquid-vapour contact means (not shown) comprising packing or trays to enable mass transfer therein to take place between a descending liquid phase and an ascending vapour phase. The argon-enriched oxygen is separated in the column 68 into argon and oxygen fractions. A stream of liquid oxygen is withdrawn from the bottom of the column 68 through an outlet 72 and is returned to the lower pressure rectification stage 20 through an inlet 74. The further rectification column 68 is provided at its top with a condenser 76 so as to provide reflux for the rectification therein. Accordingly, argon vapour passing into the condenser 76 is condensed therein. A stream of condensed argon is returned to the column 68 to provide the aforesaid reflux. A portion of the liquid argon is withdrawn as product through an outlet 78. The liquid argon typically contains up to 2% by volume of oxygen and may if desired be subject to further purification by conventional means (not shown) to produce a pure product. Refrigeration for the condenser 76 is provided by taking a part of the sub-cooled oxygen-rich liquid stream from downstream of its passage through the heat exchanger 26, passing it through a throttling valve 80 and then heat exchanging it in the condenser 76 with the condensing argon vapour. The resulting vaporised oxygen-rich liquid is then introduced into the lower pressure rectification stage 20 through an inlet 82 and is separated therein.

Various modifications and additions may be made to the process with reference to the accompanying drawings. For example, instead of or in addition to producing a liquid oxygen product in the storage vessel 60, a proportion of the sub-cooled liquid nitrogen leaving the heat exchanger 34 may be taken as product. It is preferred however that the total rate of production of liquid oxygen and liquid nitrogen product is in the range of 10 to 40% of the rate at which liquid oxygen is withdrawn through the outlet 58.

If desired, a small proportion (typically up to 10%) of the second subsidiary air stream flowing from the first expansion turbine 50 to the second expansion turbine 52 may be taken therefrom and introduced via a conduit 86 into the first subsidiary air stream. Alternatively, a proportion of the first subsidiary air stream may be taken therefrom at an intermediate region of the heat exchanger 10 and may be mixed with the second subsidiary air stream at a region intermediate the first expansion turbine 50 and the second expansion turbine 52. The relative pressures of the first and second subsidiary air streams at these regions may be selected so as to give the desired direction of flow through the conduit 86. Such interchange of fluid between the first and second subsidiary air streams via the conduit 86 facilitates design of the air separation plant to give a desired rate of production of liquid oxygen at approaching the highest possible efficiency.

In a computer-simulated example of the operation of the plant shown in the drawing, 63 596 Nm3/hr of purified air having a composition of 20.96% by volume of oxygen, 78.11% by volume of nitrogen, and 0.93% by volume of argon, flow out of the purification apparatus at a temperature of 288K and a pressure of 6.61 bar. 33 711 Nm3/hr of this flow are taken as the first subsidiary air stream and pass through the heat exchanger 10 from its warm end 12 to its cold end 14. The first subsidiary air stream leaves the cold end of the heat exchanger 10 at a temperature of 101.8K and enters the higher pressure column 18 through the inlet 16 at this pressure.

The remainder of the purified air flows from the purification apparatus 4 as the second subsidiary air stream to the compressor 42 via conduit 8 and is compressed to a pressure of 16.2 bar. 13 879 Nm3/hr of this compressed air flow are then withdrawn therefrom as the third subsidiary air stream and enter the warm end 12 of the heat exchanger 10 at a temperature of 288K. The third subsidiary air stream is withdrawn from the cold end 14 of the heat exchanger 10 at a temperature of 101.8K and a pressure of 16.1 bar. The third subsidiary air stream is then reduced in pressure by passage through the valve 55 and enters the higher pressure column 18 through the inlet 56 at the pressure of the column.

The remainder of the second subsidiary air stream flows at a rate of 16006 Nm3/hr into the compressor 44 in which it is compressed to a pressure of 25.5 bar. The second subsidiary air stream then flows into the first booster compressor 46 and is compressed thereby to a pressure of 31.8 bar and thence to the second booster compressor 48 in which it is compressed to a pressure of 50.7 bar. The second subsidiary air stream enters the warm end 12 of the main heat exchanger 10 at this pressure, and at a temperature of 288K. The second subsidiary air stream then flows through the valve 54 and is reduced to the same pressure as that of the third subsidiary air stream intermediate the cold end 14 of the heat exchanger 10 and the valve 55, and mixes with the third subsidiary air stream at this region.

A part of the second subsidiary air stream is withdrawn from the heat exchanger 10 at a temperature of 218.8K and a pressure of 50.6 bar. This air flow is then expanded in the first expansion turbine 50 and leaves the turbine 50 at a temperature of 130.0K and a pressure of 6.48 bar. 1744 Nm3/hr of this expanded air stream is withdrawn therefrom and introduced into the first air stream at an intermediate region of the heat exchanger 10. The remainder enters the second expansion turbine 52 and is expanded therein. A stream of expanded air leaves the second expansion turbine 52 at a temperature of 90.1K and a pressure of 1.49 bar and flows into the lower pressure column 20 through the inlet 40 at this pressure.

A gaseous nitrogen stream is withdrawn from the top of the lower pressure column 20 through the outlet 64 at a rate of 50395 Nm3/hr, a pressure of 1.33 bar and a temperature of 89.7K. It flows through the heat exchangers 34 and 26 and enters the cold end 14 of the heat exchanger 10 at a temperature of 98.9K and a pressure of 1.28 bar. This nitrogen stream leaves the warm end 12 of the heat exchanger 10 at a temperature of 285K and a pressure of 1.16 bar. It has a composition of 97.6% by volume nitrogen, 2.0% by volume of oxygen, and 0.4% by volume of argon.

Liquid oxygen is withdrawn from the bottom of the lower pressure column 20 at a rate of 12247 Nm3/hr and a temperature of 95.7K under a pressure of 1.75 bar. 2916 Nm3/hr of this liquid oxygen are passed to the storage vessel 60 as liquid oxygen product. The remaining liquid oxygen stream (9331 Nm3/hr) are pumped by pump 62 through the heat exchanger 10 from its cold end 14 to its warm end 12, and leave the warm end 12 at a temperature of 285K and a pressure of 6.0 bar as a gaseous oxygen product stream. The composition of both the gaseous and liquid oxygen products is 99.5% by volume of oxygen and 0.5% by volume of argon.

The process also produces 332 Nm3/hr of a liquid argon product which is 98% pure.

In the above example, 1 Nm3/hr equals 1 m3/hr at a temperature of 0° C. and a pressure of 1 atmosphere absolute, and all pressures are absolute values.

I claim:

1. A method of separating air, comprising: dividing a compressed air stream into first and second subsidiary streams; cooling the first subsidiary air stream by heat exchange to a temperature suitable for its separation by rectification; introducing the thus cooled air stream into the higher pressure stage of a double rectification column; further compressing the second subsidiary air stream; cooling at least part of it by heat exchange to a first intermediate temperature below ambient temperature but above those temperatures at which the double rectification column operates; expanding the thus cooled second subsidiary air stream in a first expansion turbine; withdrawing the thus expanded second subsidiary air stream from the first expansion turbine at a second intermediate temperature below the first intermediate temperature but above those temperatures at which the double rectification column operates and introducing it into a second expansion turbine; further expanding the second subsidiary air stream in the second expansion turbine and withdrawing the thus expanded second subsidiary air stream therefrom and introducing it into the lower pressure rectification stage of the double rectification column; separating the air in the double rectification column into oxygen and nitrogen, withdrawing oxygen and nitrogen streams from the said lower pressure stage, and producing a part of at least one of the oxygen and nitrogen as a liquid product.

2. The method as claimed in claim 1, in which the second subsidiary air stream leaves the first expansion turbine and passes to the second expansion turbine without entering into indirect heat exchange relationship with any other fluid stream.

3. The method as claimed in claim 1, in which the second subsidiary air stream enters the first expansion turbine at a pressure from 30 to 40 times higher than the outlet pressure of the second expansion turbine.

4. The method as claimed in claim 1, in which at least part of an oxygen stream withdrawn from the lower pressure stage is passed through at least one heat exchanger countercurrently to the first subsidiary air stream and is vaporised by heat exchange to form a pressurised gaseous product oxygen stream.

5. The method as claimed in claim 4, in which the oxygen stream enters the said at least one heat exchanger in liquid state.

6. The method as claimed in claim 5, in which a third subsidiary air stream is passed through the said at least one heat exchanger countercurrently to the oxygen stream.

7. The method as claimed in claim 6, in which the third subsidiary air stream passes through said heat exchanger at a pressure from 2 to 3 times the pressure at which the said pressurised gaseous oxygen product stream is taken.

8. The method as claimed in claim 1, in which the overall rate at which liquid oxygen and/or liquid nitrogen is passed to storage is from 10 to 40% of the rate at which oxygen product is withdrawn from the lower pressure stage.

9. The method as claimed in claim 1, in which a portion of the second subsidiary air stream is taken from intermediate the first and second expansion turbines and is introduced into the first subsidiary air stream at a region intermediate the warm and cold ends of a heat exchanger in which the first subsidiary air stream is cooled.

10. The method as claimed in claim 1, in which a portion of the first subsidiary air stream is taken therefrom at a region intermediate the warm and cold ends of a heat exchanger in which the first subsidiary air stream is cooled, and said portion is introduced into the secondary subsidiary air stream at a region intermediate the first and second expansion turbines.

11. The method as claimed in claim 9, in which the flow of air between the first and second subsidiary air stream is less than 10% of the flow of the second subsidiary air stream into the inlet of the second expansion turbine.

12. An apparatus for separating air, comprising: a first air compressor; first and second conduits connected to the first air compressor so that air leaving the first air compressor is able to be divided into respectively first and second subsidiary air streams; at least one heat exchanger for cooling the first subsidiary air stream by heat exchange to a temperature suitable for its separation by rectification; a double rectification column comprising a lower pressure rectification stage and a higher pressure rectification stage; a high pressure inlet to the higher pressure rectification stage for cooling the first subsidiary air stream; at least one second air compressor having an air inlet for receiving the second subsidiary air stream and an outlet communicating with said heat exchanger so as to enable air compressed in said at least one second air compressor to be cooled in the heat exchanger, a first expansion turbine for expanding the second subsidiary air stream, the first expansion turbine configured to withdraw at least part of the second subsidiary air stream from said at least one heat exchanger at a first intermediate temperature below ambient temperature but above those temperatures at which the double rectification column operates in use of the apparatus, and to discharge the second subsidiary air stream at a second intermediate temperature lower than the first intermediate temperature and higher than the temperatures at which the double rectification column operates in use of the apparatus; a second expansion turbine for further expanding the second subsidiary air stream, the second expansion turbine connected between the outlet of the first expansion turbine and a low pressure inlet of the lower pressure rectification stage; and low pressure outlets for withdrawing oxygen and nitrogen streams from the lower pressure stage of the double rectification column; at least one said low pressure outlets communicating at one of its ends with one of liquid nitrogen and liquid oxygen in the double rectification column and at its other end with a storage vessel for one of the liquid nitrogen and liquid oxygen.

* * * * *